US005694953A

United States Patent [19]

Stephan et al.

[11] Patent Number: 5,694,953

[45] Date of Patent: Dec. 9, 1997

[54] HAIR DRESSING COMB

[76] Inventors: Carl Wilfred Benjamin Stephan, P.O. Box 1971, Somerset West 7129, South Africa; Raymond Connell Gibboney, 3880 Dial Mill Rd., Convers, Ga. 30208

[21] Appl. No.: 714,039

[22] PCT Filed: Mar. 3, 1995

[86] PCT No.: PCT/US95/02533

§ 371 Date: Nov. 12, 1996

§ 102(e) Date: Nov. 12, 1996

[87] PCT Pub. No.: WO95/23536

PCT Pub. Date: Sep. 8, 1995

[30] Foreign Application Priority Data

Mar. 3, 1994 [ZA] South Africa ..... 94/1495

[51] Int. Cl.[6] ..... A45D 19/18; A45D 24/00

[52] U.S. Cl. ..... 132/160; 132/219; 132/270

[58] Field of Search ..... 132/219, 160, 132/270, 212, 107, 138, 144, 280, 901

[56] References Cited

U.S. PATENT DOCUMENTS 1,533,684 4/1925 Abeel ..... 132/160
2,806,476 5/1957 Thompson .
2,915,071 5/1959 Watkins .
3,575,183 4/1971 Tanner, Sr. ..... 132/160
4,996,996 3/1991 Hirsh .
5,152,306 10/1992 Stephan .

FOREIGN PATENT DOCUMENTS 811272 8/1951 Germany ..... 132/219

*Primary Examiner*—Todd E. Manahan
*Attorney, Agent, or Firm*—Bell, Seltzer, Park & Gibson, P.A.

[57] ABSTRACT

A hairdressing comb (10) comprises a series of spaced pairs of hair-lifting teeth (16.1, 16.2), the teeth of each pair defining between them a gap 18 into which hair can enter. Each hair-lifting tooth has a hair-lifting formation (20.1, 20.2), the hair-lifting formations of each pair of teeth both extending into the corresponding gap (18). The hair-lifting formations (20.1, 20.2) of each pair of teeth (16.1, 16.2) are staggered with respect to one another in the longitudinal direction of the teeth (16.1, 16.2), and the one hair-lifting formation (20.2) extends into the gap (18) to a point laterally beyond that to which the other hair lifting formation (20.2) extends into the gap (18).

5 Claims, 2 Drawing Sheets

HAIR DRESSING COMB

BACKGROUND OF THE INVENTION

I. Field of the Invention

The present invention relates generally to the field of hairdressing combs. More particularly, it relates to a hairdressing comb for use in lifting streaks of hair from a scaled out section of hair during a highlighting or other hair-beautifying procedure. Such a procedure is, for example, described in my U.S. Pat. No. 5,152,306.

II. Description of the Related Art

U.S. Pat. No. 4,996,996 (Hirsh) discloses a comb which has a series of hair-lifting teeth, each with a hair-lifting formation which extends at an acute angle from the respective tooth, the hair-lifting formations all being on the same side of the teeth. The comb disclosed in my U.S. Pat. No. 5,152,306 improved on this construction by providing one or more teeth without hair-lifting formations (i.e. plain teeth) between each pair of hair-lifting teeth.

SUMMARY OF THE INVENTION

It is an object of the present invention to improve yet further on this construction.

According to the present invention there is provided a hairdressing comb in which the hair-lifting formation of each pair of adjacent hair-lifting teeth both extend laterally into the gap between the teeth of that pair, the one hair-lifting formation of each said pair extending into the respective gap to a point laterally beyond that to which the other hairlifting formation of that pair extends into the respective gap.

The hair-lifting formations of each said pair of teeth may be staggered with respect to one another, in the longitudinal direction of the teeth.

In one form of the invention the spaces between adjacent pairs of hair-lifting teeth may be unoccupied by other teeth or hair-lifting formations.

In another form of the invention the spaces between adjacent pairs of hair-lifting teeth may be occupied by one or more further teeth, the further teeth being without hair lifting formations.

BRIEF DESCRIPTION OF THE DRAWINGS

The invention will now be described in more detail, by way of example, with reference to the accompanying drawings.

In the drawings.

DESCRIPTION OF THE PREFERRED EMBODIMENTS

Figure 1:
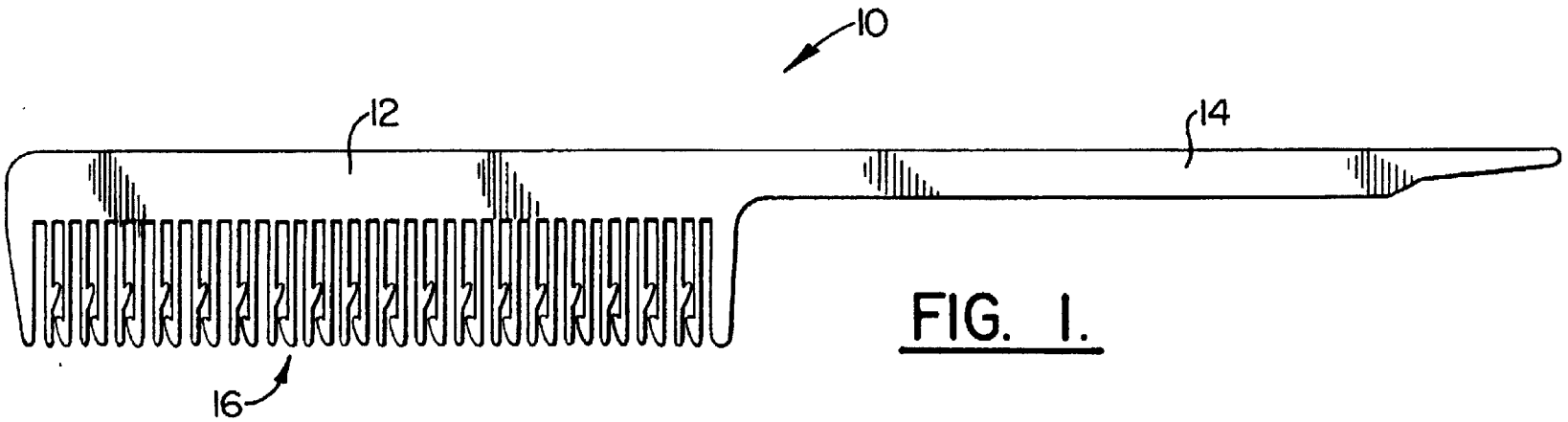
FIG. 1 is a side view of a comb in accordance with one embodiment of the invention.
Figure 3:
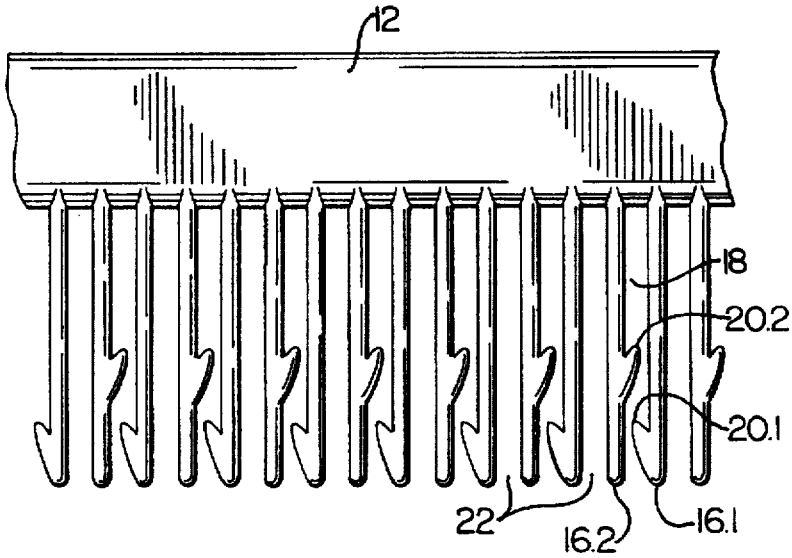
FIG. 3 shows part of the comb of FIG. 1, drawn to a larger scale, to illustrate more clearly the tooth configuration of the comb.

Referring first to FIGS. 1 and 3, reference numeral 10 generally indicates a comb which has a spine 12, a handle or rat-tail 14, and a series of teeth 16 extending from the spine.

As can best be seen in FIG. 3, the teeth 16 are arranged in spaced pairs, each pair comprising a tooth 16.1 and a tooth

16.2, the teeth 16.1 and 16.2 defining between them a gap 18 into which hair can enter.

The tooth 16.1 has a first hair-lifting formation 20.1 which extends at an acute angle laterally into the gap 18, whereas the second tooth 16.2 has a hair-lifting formation 20.2 which extends at an acute angle laterally into the gap 18. The two hair-lifting formations 20.1 and 20.2 are staggered with respect to one another in the longitudinal direction of the teeth, and the one hair-lifting formation extends into the gap. In other words, the formations 20.1 and 20.2 overlap one another.

Between adjacent pairs of hair-lifting teeth 16.1, 16.2 there is a gap 22 which is unoccupied by any other teeth or hair-lifting formations.

In use, when the comb 10 is brought down on a scaled out section of hair, portions of the hair will enter into the gaps 18, and other portions of the hair will enter into the gaps 22. When the comb is lifted again, those portions of hair which have entered into the gaps 18 will be lifted by the hair-lifting formations 20.1 and 20.2. Because the hair-lifting formations 20.1 and 20.2 extend into the corresponding gaps 18 in an overlapping manner, all the hair that has entered into the gap 18 beyond at least the formation 20.1 will be lifted. Those portions of the hair that have entered into the gaps 22, however, will leave the gaps again unhindered when the comb is lifted.

It is to be noted that all that is required to lift precisely measured streaks of hair from a scaled out section of hair during a highlighting or other hair-beautifying procedure, is to bring the comb down onto the section of hair and then to lift it again. No "rocking" of the comb (in the length-wise direction of the spine) is necessary to ensure that all the hair that has entered into the gaps 18 is lifted by the hair-lifting formations 20.1 and 20.2. This significantly improves the ease with which even unskilled persons can carry out highlighting or other hair-beautifying procedures which require the lifting out of streaks of hair.

Figure 2:
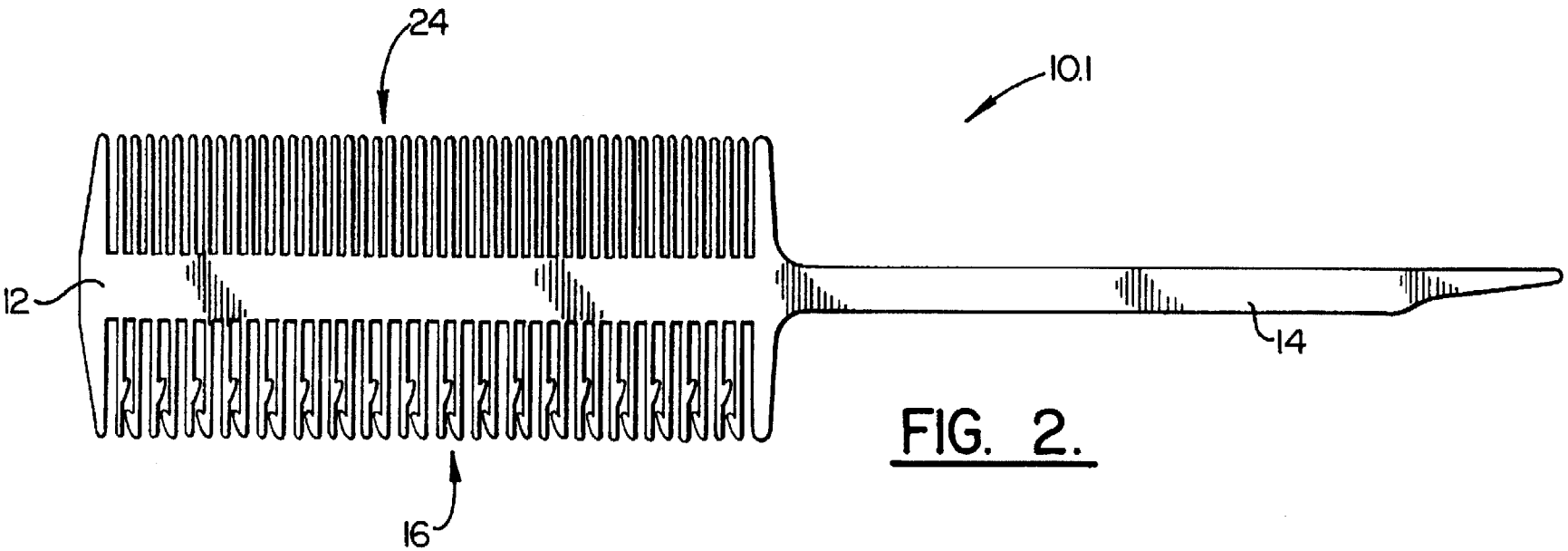
FIG. 2 is a side view of a comb in accordance with another embodiment of the invention.

Referring now to FIG. 2, there is shown a comb 10.1 which is similar to the comb 10, the same reference numerals being used to indicate the same or equivalent parts. The comb 10.1 differs from the comb 10 in that it is double-sided, having a series of plain teeth 24, without hair-lifting formations, which extend from the spine 12 on that side thereof which is opposite the teeth 16.

Figure 4:
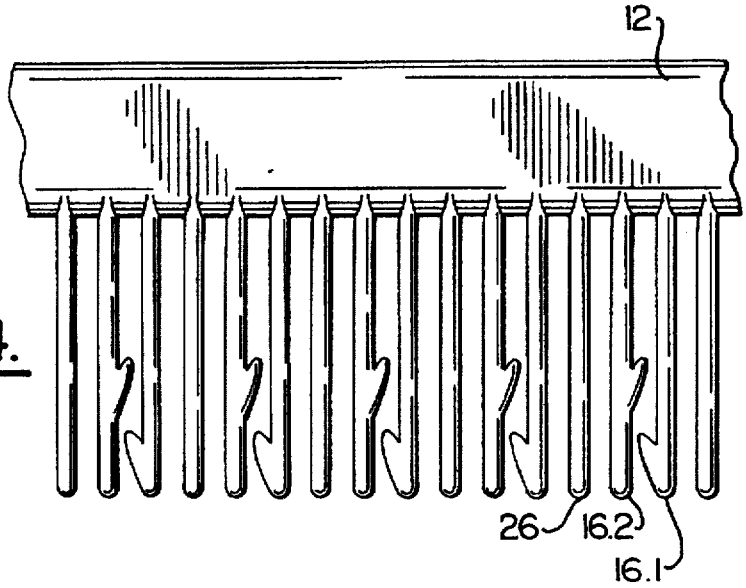
FIGS. 4 and 5 illustrate two alternative tooth configurations in accordance with the invention.

The configuration illustrated in FIG. 4 differs from that illustrated in FIG. 3 in that the spacing between adjacent pairs of hair-lifting teeth 16.1, 16.2 is greater, there being, in each space between adjacent pairs of hair-lifting teeth, a single plain tooth 26, i.e. 3 a tooth without hair-lifting formations.

Figure 5:
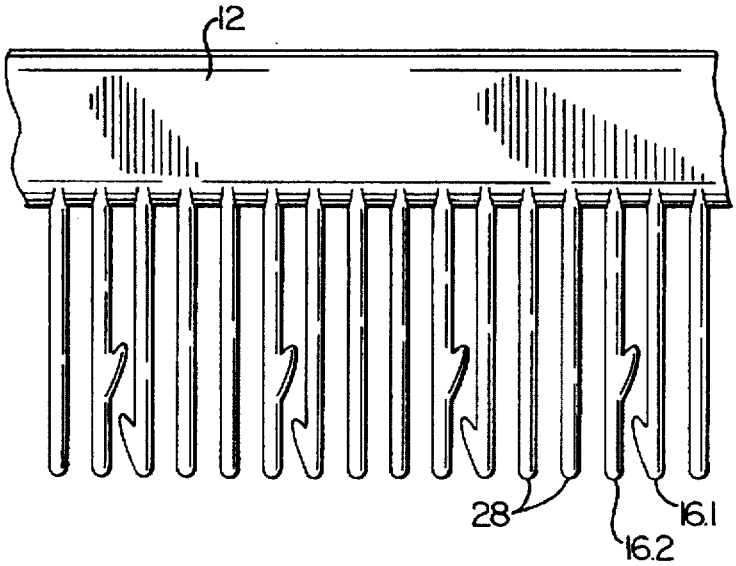

The configuration illustrated in FIG. 5 differs from that illustrated in FIG. 4 in that the spacing between adjacent pairs of hair-lifting teeth 16.1, 16.2 is even greater than that in the FIG. 4 embodiment, there being, in each space between adjacent pairs of hair-lifting teeth, two plain teeth 28.

What is claimed is:

1. A hairdressing comb for use in lifting streaks of hair from a scaled out section of hair during a hair-beautifying procedure, the comb comprising:

a spine, a series of spaced pairs of hair-lifting teeth depending from the spine, each of the teeth having a longitudinal axis, the teeth of each said pair of hair-lifting teeth defining a gap between each said pair into which streaks of hair can enter, each hair-lifting tooth of each said pair of hair-lifting teeth having a hair-lifting formation which extends at an acute angle from the respective tooth, each hair-lifting formation extending laterally into the gap between each said pair of hair-lifting teeth, each hair-lifting tooth of each said pair of hair-lifting teeth having a distal end and a proximal end, each proximal end being juxtaposed adjacent to the spine of the comb, a first hair-lifting tooth of each of said pair of hair-lifting teeth having the hair-lifting formation adjacent to the distal end of the tooth, a second hair-lifting tooth of each of said pair of hair-lifting teeth having the hair-lifting formation spaced along the longitudinal axis of the tooth in a direction toward the proximal end of the tooth and spaced longitudinally from the hair-lifting formation of the first hair-lifting tooth.

2. A hairdressing comb as claimed in claim 1, wherein adjacent pairs of hair-lifting teeth define a space therebetween.

3. A hairdressing comb as claimed in claim 2, wherein the space between adjacent pairs of hair-lifting teeth is unoccupied by other comb teeth.

4. A hairdressing comb as claimed in claim 2, wherein the space between adjacent pairs of hair-lifting teeth is occupied by at least one tooth having no hair-lifting formations thereon.

5. A hairdressing comb as claimed in claim 2, wherein the space between adjacent pairs of hair-lifting teeth is occupied by a plurality of teeth having no hair-lifting formations thereon.

* * * * *